US009897960B2

(12) United States Patent
Ootsuka et al.

(10) Patent No.: US 9,897,960 B2
(45) Date of Patent: Feb. 20, 2018

(54) IMAGE FORMING APPARATUS

(71) Applicant: CANON KABUSHIKI KAISHA, Tokyo (JP)

(72) Inventors: Masahiro Ootsuka, Tokyo (JP); Ichiro Katsuie, Takasaki (JP); Shoji Naruge, Kashiwa (JP); Ryohei Terada, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/341,361

(22) Filed: Nov. 2, 2016

(65) Prior Publication Data

US 2017/0139365 A1 May 18, 2017

(30) Foreign Application Priority Data

Nov. 16, 2015 (JP) ..... 2015-223852

(51) Int. Cl.
*G03G 15/08* (2006.01)
*G03G 15/00* (2006.01)
*G03G 21/20* (2006.01)

(52) U.S. Cl.
CPC ..... *G03G 15/556* (2013.01); *G03G 15/0822* (2013.01); *G03G 15/0831* (2013.01); *G03G 15/0867* (2013.01); *G03G 21/20* (2013.01); *G03G 2215/0888* (2013.01)

(58) Field of Classification Search
CPC ..... G03G 15/556; G03G 15/0822; G03G 15/0831; G03G 15/0867; G03G 21/20; G03G 2215/0888
See application file for complete search history.

(56) References Cited

U.S. PATENT DOCUMENTS 5,774,773 A * 6/1998 Otsuka ..... G03G 15/0868 399/262
2005/0129420 A1* 6/2005 Mimura ..... G03G 15/0849 399/27

FOREIGN PATENT DOCUMENTS

JP 10-333407 A 12/1998

* cited by examiner

*Primary Examiner* — Ryan Walsh
(74) *Attorney, Agent, or Firm* — Fitzpatrick, Cella, Harper & Scinto

(57) ABSTRACT

An image forming apparatus including a toner container, a toner amount detection unit, a driving unit, a toner accommodating unit, a remaining toner amount detection unit, and a control unit is provided. The toner container supplies the toner to the toner accommodating unit by being rotated in a first direction. The toner amount detection unit detects a value related to an amount of the toner in the toner container. The control unit controls the driving unit so as to rotate the toner container in a second direction in a case where the remaining-toner amount detection unit has detected that the amount of the toner accommodated by the toner accommodating unit is smaller than a first set amount and the amount of the toner contained in the toner container detected by the toner amount detection unit reaches a second set amount.

7 Claims, 9 Drawing Sheets

IMAGE FORMING APPARATUS

BACKGROUND OF THE INVENTION

Field of the Invention

The present invention relates to an image forming apparatus which adopts such a system as an electrophotographic system or an electrostatic recording system. More specifically, the present invention relates to an image forming apparatus that supplies toner to an apparatus body by rotating a cylindrical toner container that contains the toner.

Description of the Related Art

Conventionally, there are wide variety of applications of an image forming apparatus using an electrophotographic system. The applications include a copier, a printer, a plotter, a facsimile machine, and a multifunctional apparatus having plural functions of these. In these image forming apparatuses, fine powder toner is used as a component of a developer for image formation. As the image forming apparatus that uses toner, an image forming apparatus provided with a container that is filled with toner and is attachable to and detachable from an apparatus body is widely used. The container will be hereinafter referred to as a toner container.

As a toner container, a container disclosed in Japanese Unexamined Patent Application Publication No. 10-333407 that is made of plastics, has an approximately cylindrical shape, and contains toner is widely used. The toner container includes a spiral rib and a discharge port. The spiral rib is formed by a spiral recess defined on the circumferential surface of the toner container so as to project toward the inside of the toner container, and the discharge port is provided in one end portion of the toner container. In the case where this toner container is rotated in a normal rotation direction, as a first rotation direction, by a drive source, the contained toner is conveyed by the rib toward the discharge port and discharged through the discharge port.

This image forming apparatus is also provided with a toner hopper that is capable of reserving the toner supplied from the toner container attached to the apparatus body and of supplying the reserved toner to a developing unit. The toner hopper is provided with a supplying screw that rotates, and the toner is supplied from the toner hopper to the developing unit by the rotation of the supplying screw. The toner hopper is provided with a toner detection sensor, and the toner is supplied from the toner container to the toner hopper when a control unit does not detect the toner in the toner hopper by the toner detection sensor. The amount of toner discharged from the toner container may sometimes vary depending on the amount of toner in the toner container even if the rotation speed is the same. However, the toner hopper can supply a stable amount of toner to the developing unit even in the case where the amount of toner discharged through the discharge port along with the rotation of the toner container is not constant because the toner hopper reserves a predetermined amount of toner.

In addition, in the case where the toner detection sensor does not detect the toner in the toner hopper for several consecutive times, the control unit determines that the image forming apparatus is in a toner-end state in which a desired amount of toner cannot be supplied to the toner hopper due to decrease in the amount of toner remaining in the toner container. In this case, the control unit displays on a display unit a screen to prompt a user to replace the toner container to notify the user that the time to replace the toner container has come.

However, in the image forming apparatus according to Japanese Unexamined Patent Application Publication No. 10-333407 described above, the control unit rotates the toner container only in the normal rotation direction. Thus, clogging with toner may occur in the vicinity of the discharge port of the toner container in the case where the fluidity of the toner has decreased in, for example, a high-temperature and high-humidity environment. If the clogging with toner occurs in the toner container, the discharge performance of the toner from the toner container will decrease. This will cause a supplement malfunction from the toner container to the toner hopper and the control unit will be no longer able to detect the toner in the toner hopper by the toner detection sensor. This may cause a detection error in the detection of the amount of toner in the toner container by the control unit and may cause a false detection of toner shortage, which may cause the screen for the replacement of the toner container to be displayed even when the amount of toner remaining in the toner container is sufficient.

SUMMARY OF THE INVENTION

The present invention provides an image forming apparatus that can suppress a clogging with toner in a toner container caused by decrease in the fluidity of the toner.

According to an aspect of the present invention, an image forming apparatus includes a toner container, a toner amount detection unit, a driving unit, a toner accommodating unit, a remaining-toner amount detection unit, and a control unit. The toner container has a cylindrical shape and is configured to contain toner. The toner container includes a discharge port through which the toner is discharged and a conveyance portion. The conveyance portion is configured to convey the toner toward the discharge port by rotating in a first direction. The toner amount detection unit is configured to detect a value related to an amount of the toner contained in the toner container. The driving unit is capable of rotating the toner container in the first direction and in a second direction opposite to the first direction. The toner accommodating unit is configured to accommodate the toner discharged from the toner container. The remaining-toner amount detection unit is configured to detect whether an amount of the toner accommodated by the toner accommodating unit reaches a first set amount. The control unit is configured to control the driving unit such that the driving unit rotates the toner container in the second direction in a case where the remaining-toner amount detection unit has detected that the amount of the toner accommodated by the toner accommodating unit is smaller than the first set amount and the amount of the toner contained in the toner container detected by the toner amount detection unit reaches a second set amount.

Further features of the present invention will become apparent from the following description of exemplary embodiments with reference to the attached drawings.

DESCRIPTION OF THE EMBODIMENTS

First Exemplary Embodiment

A first exemplary embodiment of the present invention will be described in detail below with reference to FIGS. 1 to 7. In the present exemplary embodiment, a tandem-type full-color printer will be described as an exemplary image forming apparatus. It should be noted that embodiments of the present invention are not limited to the tandem-type image forming apparatus and may be image forming apparatuses of other types. In addition, the embodiments are neither limited to full-color printers and may be monochrome printers.

Figure 1:
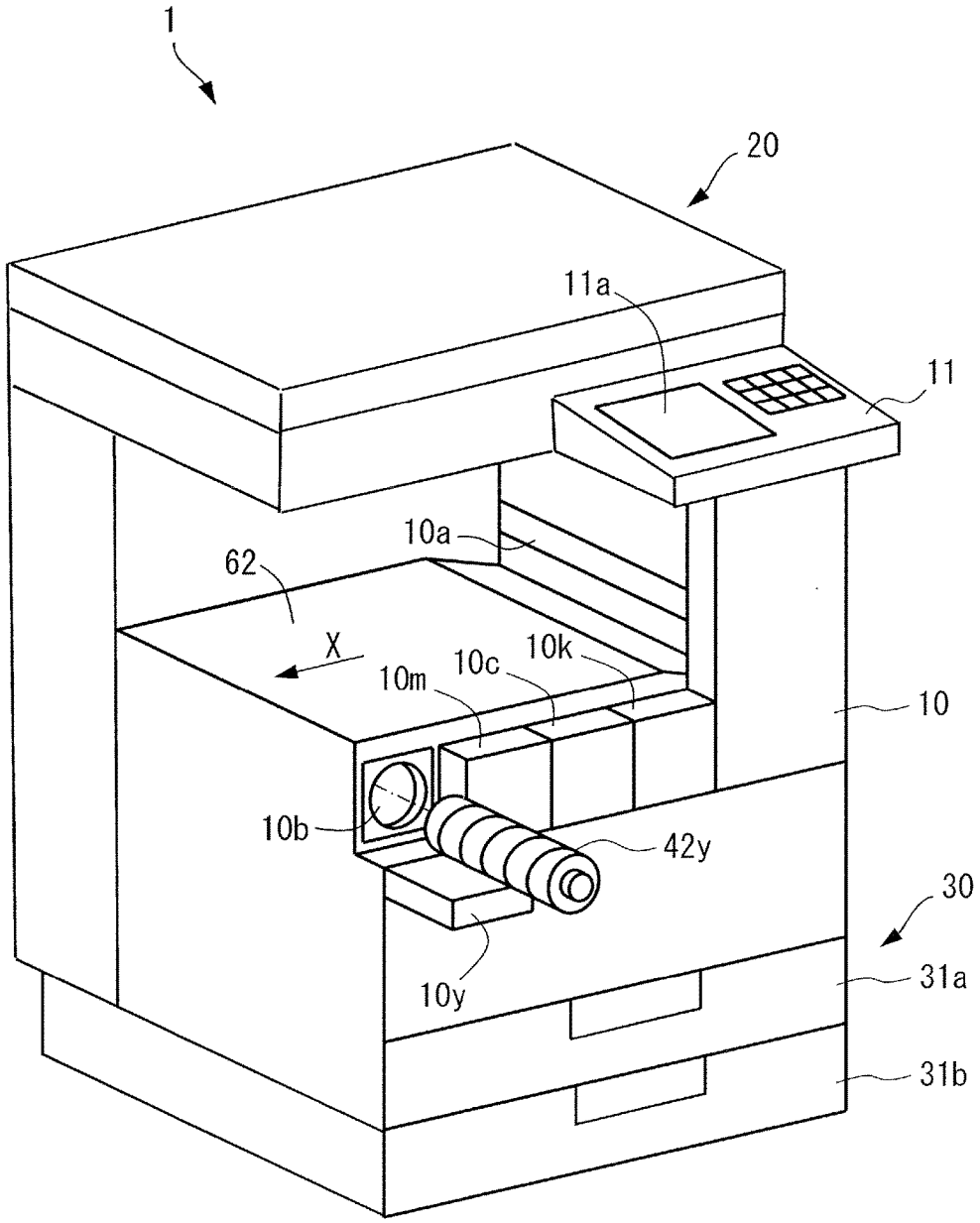
FIG. 1 is a perspective view illustrating a schematic configuration of an image forming apparatus according to a first exemplary embodiment.
Figure 2:
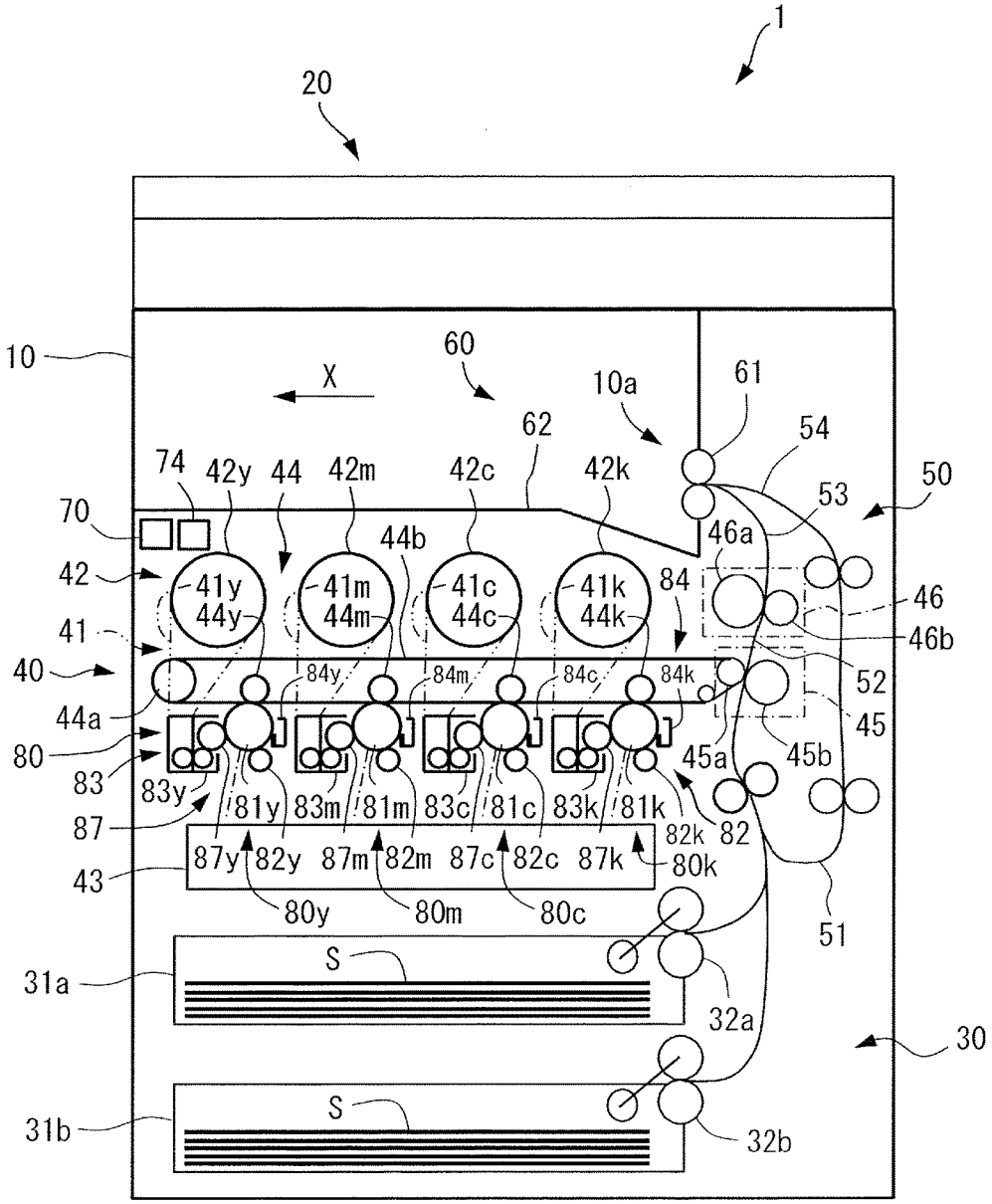
FIG. 2 is a schematic section view of the image forming apparatus according to the first exemplary embodiment.

As illustrated in FIGS. 1 and 2, an image forming apparatus 1 includes an image forming apparatus body 10 serving as a body. The image forming apparatus body 10 will be hereinafter referred to as an apparatus body 10. An operation panel 11 is provided on an upper-front portion of the apparatus body 10. The operation panel 11 is provided with a display unit 11*a* in addition to operation buttons. The display unit 11*a* is capable of displaying the state of the image forming apparatus 1.

Figure 3:
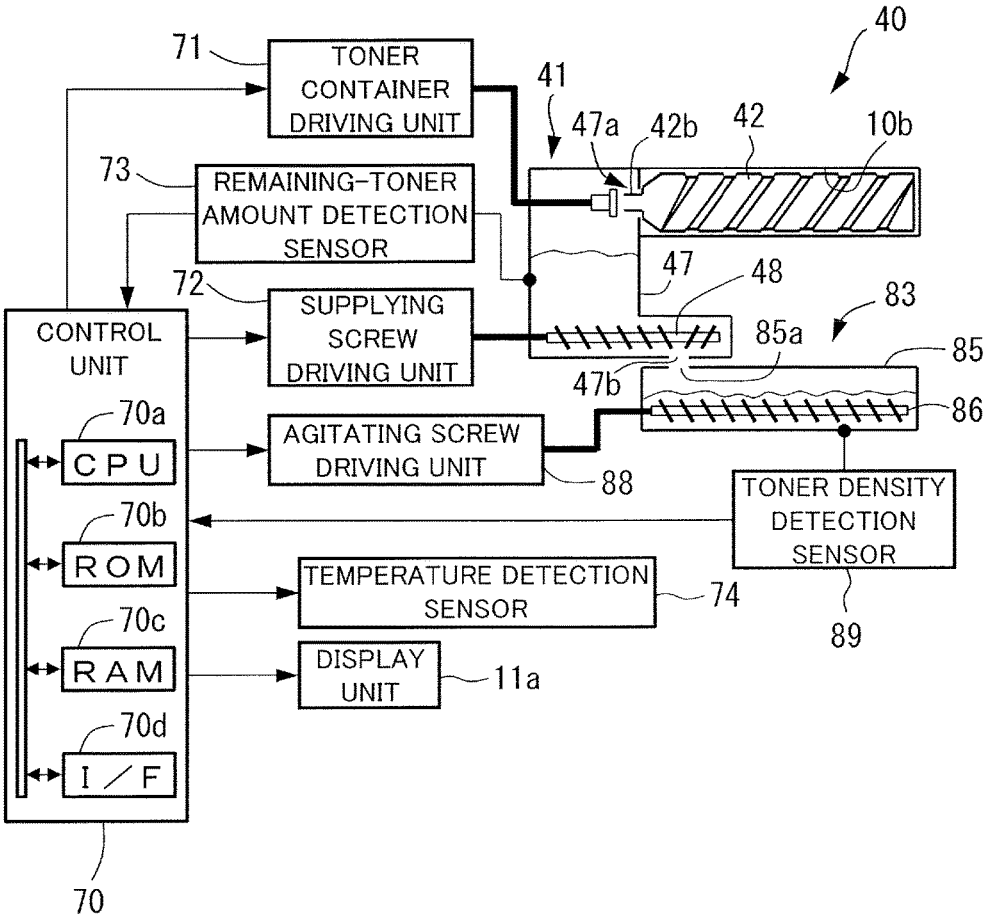
FIG. 3 illustrates connection of a control unit of the image forming apparatus according to the first exemplary embodiment.

As illustrated in FIG. 2, the apparatus body 10 includes an image reading unit 20, a sheet feeding unit 30, an image forming section 40, a sheet conveyance unit 50, a sheet discharge portion 60, and a control unit 70 serving as a toner amount detection unit. A sheet S serving as a recording material is to bear a toner image formed thereon. Specific examples of the sheet S include a plain paper sheet, a sheet of resin serving as a substitute for plain paper, a cardboard, and a sheet for an overhead projector. A temperature detection sensor 74 that serves as an information obtaining unit and as a temperature detection unit and is capable of measuring the temperature inside the apparatus body 10 is provided in the apparatus body 10 and connected to the control unit 70 as illustrated in FIG. 3. The temperature detection sensor 74 obtains information related to the environment of toner contained in a toner container 42. In the present exemplary embodiment, the information obtaining unit is also the temperature detection unit that detects the temperature inside the apparatus body 10 that houses the toner container 42 in an attachable and detachable manner.

The image reading unit 20 is provided on an upper portion of the apparatus body 10. The image reading unit 20 includes, for example, platen glass, a light source, and an image sensor that are not illustrated. The platen glass serves as a stage on which a document is to be placed. The light source irradiates the document placed on the platen glass with light. The image sensor converts reflected light into a digital signal.

The sheet feeding unit 30 is disposed in a lower portion of the apparatus body 10 and includes sheet cassettes 31*a* and 31*b* and feed rollers 32*a* and 32*b*. Each of the sheet cassettes 31*a* and 31*b* supports and accommodates the sheet S such as a recording sheet, and the sheet feeding unit 30 feeds the accommodated sheet S to the image forming section 40.

The image forming section 40 includes image forming units 80, toner hoppers 41 each serving as a toner accommodating unit, toner containers 42, a laser scanner 43, an intermediate transfer unit 44, a secondary transfer unit 45, and a fixing unit 46. The image forming section 40 is capable of forming an image on the sheet S on the basis of image information. The image forming apparatus 1 of the present exemplary embodiment is capable of full-color printing, and the image forming units 80 are provided as image forming units 80*y*, 80*m*, 80*c*, and 80*k* each corresponding to a different color in four colors of yellow, magenta, cyan, and black. The image forming units 80*y*, 80*m*, 80*c*, and 80*k* are identical in configuration, and the reference letters y, m, c, and k respectively correspond to yellow, magenta, cyan, and black. In a similar manner, the toner hoppers 41 and the toner containers 42 are provided as toner hoppers 41*y*, 41*m*, 41*c*, and 41*k* and toner containers 42*y*, 42*m*, 42*c*, and 42*k* each corresponding to a different color in four colors of yellow, magenta, cyan, and black. Therefore, in FIG. 2, components corresponding to respective colors are illustrated with identifiers of colors added after the reference numerals thereof. However, the components may be described with only the reference numerals without the identifiers of the colors in the illustration in FIGS. 3 to 9B and the description in the specification.

The toner containers 42*y*, 42*m*, 42*c*, and 42*k* are, for example, bottles in a cylindrical shape, contain the toner, and are disposed above the image forming units 80*y*, 80*m*, 80*c*, and 80*k* with the toner hoppers 41*y*, 41*m*, 41*c*, and 41*k* interposed therebetween. In the present exemplary embodiment, a toner having an average particle diameter of about 6 μm obtained by pulverizing and classifying a kneaded mixture of a resin binder with a pigment is used as the toner. A main component of the resin binder is polyester. Here, as illustrated in FIG. 1, toner container covers 10*y*, 10*m*, 10*c*, and 10*k* are openably and closably provided on a front portion of the apparatus body 10. For example, when the toner container cover 10*y* is open, the toner container 42*y* is attachable to and detachable from the toner container accommodation portion 10*b* of the apparatus body 10 from the front side. In a similar manner, when the toner container covers 10*m*, 10*c*, and 10*k* are open, the toner containers 42*m*, 42*c*, and 42*k* are attachable to and detachable from the apparatus body 10 from the front side.

Figure 4A:
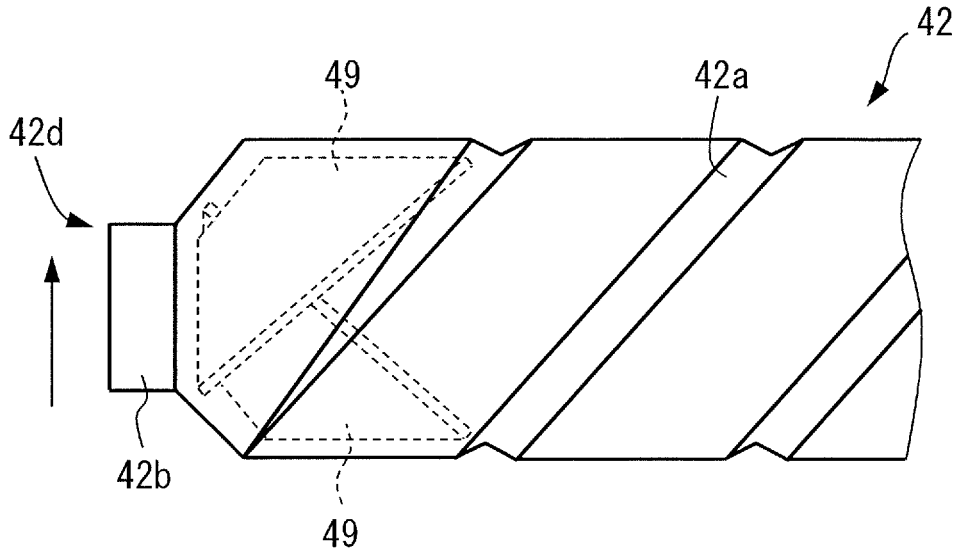
FIG. 4A is a side view of a toner container of the image forming apparatus according to the first exemplary embodiment.
Figure 4B:
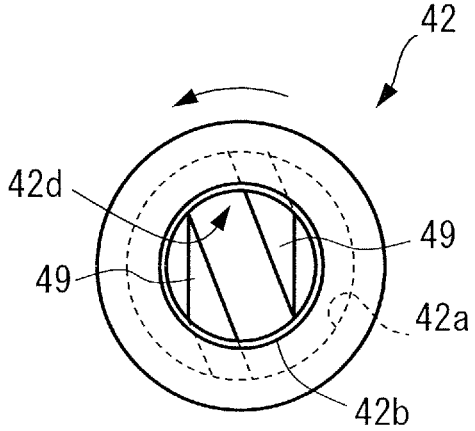
FIG. 4B is a front view of the toner container illustrated in FIG. 4A.

As illustrated in FIGS. 4A and 4B, the toner container 42 has a cylindrical shape, contains the toner, and includes a spiral rib 42*a* and a discharge port 42*b*. The spiral rib 42*a* is provided in the inner circumferential surface of the toner container 42. The discharge port 42*b* is provided in one end portion of the toner container 42. The toner contained in the toner container 42 can be discharged by being guided to the discharge port 42*b* by the rib 42*a* as a result of the toner container 42 rotating about a center axis in a normal rotation direction, i.e. a first rotation direction or an illustrated arrow direction. The rib 42*a* is provided continuously so as to extend from the discharge port 42*b* to the other end portion of the toner container 42, and all the toner contained in the toner container 42 is conveyed toward the discharge port 42*b* in the case where the toner container 42 rotates in the normal rotation direction. Meanwhile, in the case where the toner container 42 rotates in a reverse rotation direction, i.e. a second rotation direction, all the toner contained in the toner container 42 is conveyed toward the side opposite to the discharge port 42*b*. The inner diameter of the discharge port 42*b* is set to be smaller than the inner diameter of a toner containing portion of the toner container 42. At a portion inside the toner container 42 and in the vicinity of the discharge port 42*b*, for example, two baffles 49 are provided. The baffles 49 scoop the toner in the toner container 42 to discharge the toner through the discharge port 42*b* by integrally rotating with the toner container 42.

As illustrated in FIG. 2, the image forming units 80 include photosensitive drums 81*y*, 81*m*, 81*c*, and 81*k*, electrifying rollers 82, developing units 83, and cleaning blades 84. In the present exemplary embodiment, the image forming units 80 are attachable to and detachable from the apparatus body 10. In addition, the photosensitive drums 81, the electrifying rollers 82, the developing units 83, the cleaning blades 84, and developing sleeves 87 described later are also provided such that components with identical configurations are provided so as to respectively correspond to different colors of the four colors of yellow, magenta, cyan, and black.

The photosensitive drum 81 is rotated by a drum motor that is not illustrated, bears an electrostatic image formed on the basis of image information in forming an image, and moves the electrostatic image by rotation. The electrifying roller 82 comes into contact with the surface of the photosensitive drum 81 and electrifies the surface.

As illustrated in FIG. 3, the developing unit 83 includes a developer container 85, an agitating screw 86, and a developing sleeve 87 illustrated in FIG. 2. The developing sleeve 87 is provided at an opening portion of the developer container 85 so as to be rotatable. The developer container 85 is supplied with the toner through a replenishing port 85*a* via the toner hopper 41 from the toner container 42 filled with the toner. The developer container 85 contains two-component toner that is a mixture of nonmagnetic toner and a magnetic carrier. The agitating screw 86 is connected to an agitating screw driving unit 88 including a motor, a gear train, and so forth. The agitating screw 86 is rotated by the drive of the agitating screw driving unit 88, and the toner is negatively electrified by friction as a result of the toner and the magnetic carrier being rubbed with each other.

As illustrated in FIG. 2, the developing sleeve 87 has a function of, as an effect of a magnet fixed in an inner space thereof, magnetically bearing developer contained in the developer container 85 and conveying the developer to a gap portion between the developing sleeve 87 and the photosensitive drum 81. The developing sleeve 87 is connected to a high-voltage power source that is not illustrated and applies a developing bias to the developing sleeve 87. In the developing bias, a direct current voltage and an alternating current voltage are superposed on each other. The developing sleeve 87 executes a developing process by causing the toner to attach to an electrostatic latent image with the developing bias.

In addition, as illustrated in FIG. 3, a toner density detection sensor 89, e.g., an inductive sensor, is provided in a part of a bottom portion of the developer container 85. The toner density detection sensor 89 is capable of detecting the amount of toner in the developer container 85 and transmits the results of detection to the control unit 70.

The toner hopper 41 includes an accommodating container 47 and a supplying screw 48 provided at a lower portion of the accommodating container 47, and accommodates the toner discharged from the toner container 42. The accommodating container 47 has a substantially vertically long shape, and includes a receiving port 47*a* and a supplying port 47*b*. The receiving port 47*a* is defined as an opening in an upper portion of the accommodating container 47, and an end portion of the toner container 42 including the discharge port 42*b* is inserted in the receiving port 47*a*. The supplying port 47*b* is defined as an opening defined in a bottom surface of the accommodating container and opposing the replenishing port 85*a* of the developer container 85. The receiving port 47*a* is a circular through hole defined in the accommodating container 47 and the diameter thereof is larger than the outer diameter of the discharge port 42*b* of the toner container 42. The supplying screw 48 rotates to discharge the toner accommodated in the accommodating container 47 through the supplying port 47*b* and thereby supplies the toner to the developer container 85 through the replenishing port 85*a*.

A toner container driving unit 71 serving as a driving unit and a supplying screw driving unit 72 are provided in the vicinity of the toner hopper 41. The toner container driving unit 71 includes a motor, a gear train, and so forth, is connected to the toner container 42 inserted in the receiving port 47*a*, and is capable of rotating the toner container 42 about the center axis of the toner container 42 in the normal and reverse rotation directions. In addition, the toner container driving unit 71 is capable of discharging the toner from the toner container 42 by rotating the toner container 42 in the normal rotation direction, and is capable of conveying the toner to the side opposite to the discharge port 42*b* by rotating the toner container 42 in the reverse rotation direction. The supplying screw driving unit 72 includes a motor, a gear train, and so forth, is connected to the supplying screw 48, and is capable of rotating the supplying screw 48. That is, the supplying screw driving unit 72 and the supplying screw 48 are capable of supplying the toner accommodated in the toner hopper 41 to the developing unit 83. The toner container driving unit 71 and the supplying screw driving unit 72 are both connected to the control unit 70, and the drive of these driving units are controlled by the control unit 70.

In addition, a remaining-toner amount detection sensor 73 serving as a remaining-toner amount detection unit is provided on a part of a side wall of the accommodating container 47. The remaining-toner amount detection sensor 73 detects whether or not the amount of toner accommodated in the toner hopper 41 reaches a predetermined set amount, i.e., one example of a first set amount. Here, the toner hopper 41 is capable of accommodating toner of an amount equal to or larger than the maximum amount of toner that can be supplied from the toner hopper 41 to the developing unit 83 in a total time of a predetermined time and a discharge time. In addition, in the present exemplary embodiment, the remaining-toner amount detection sensor 73 is provided so as to be capable of detecting whether or not the toner of an amount equal to or larger than the maximum amount is accommodated in the toner hopper 41. Therefore, the toner in the toner hopper 41 does not run out before completing an operation of discharging the toner, and a malfunction such as being unable to achieve a desired image density as a result of being unable to maintain the replenishment of the developing unit 83 can be prevented beforehand. The remaining-toner amount detection sensor 73 is, for example, a piezo sensor, and detects the height of a toner powder plane by utilizing the fact that the output voltage of the remaining-toner amount detection sensor 73 varies depending on the presence of toner in the vicinity of a sensor surface. That is, the remaining-toner amount detection sensor 73 is capable of detecting whether or not the toner is accommodated in the toner hopper 41. The remaining-toner amount detection sensor 73 is connected to the control unit 70 and transmits the detection results to the control unit 70.

As illustrated in FIG. 2, the cleaning blade 84 is disposed in contact with the surface of the photosensitive drum 81 and cleans the developer remaining on the surface of the photosensitive drum 81 after primary transfer. The cleaning blade 84 is formed of, for example, urethane rubber, and is attached to and supported by a metal support plate that is not illustrated.

The laser scanner 43 exposes the surface of the photosensitive drum 81 electrified by the electrifying roller 82 to light to form an electrostatic latent image on the surface of the photosensitive drum 81.

The intermediate transfer unit 44 is disposed above the image forming units 80. The intermediate transfer unit 44 includes a plurality of rollers including a driving roller 44*a*, a driven roller that is not illustrated, primary transfer rollers 44*y*, 44*m*, 44*c*, and 44*k*, and so forth and an intermediate transfer belt 44*b* looped over these rollers. The primary transfer rollers 44*y*, 44*m*, 44*c*, and 44*k* are respectively disposed so as to oppose the photosensitive drums 81*y*, 81*m*, 81*c*, and 81*k* and abut the intermediate transfer belt 44*b*.

The intermediate transfer belt 44*b* is subjected to a tension stronger than a certain strength even when the intermediate transfer belt 44*b* is not driven. The intermediate transfer belt 44*b* is not separated from but always in contact with the photosensitive drums 81*y*, 81*m*, 81*c*, and 81*k*. By applying a transfer bias of a positive polarity to the intermediate transfer belt 44*b* via the primary transfer rollers 44*y*, 44*m*, 44*c*, and 44*k*, toner images on the photosensitive drums 81*y*, 81*m*, 81*c*, and 81*k* each having a negative polarity are sequentially transferred onto the intermediate transfer belt 44*b* so as to be superimposed on one another. In this way, the color toner images on the surfaces of the photosensitive drums 81*y*, 81*m*, 81*c*, and 81*k*, which are obtained by developing the electrostatic images, are transferred onto the intermediate transfer belt 44*b* and conveyed.

The secondary transfer unit 45 includes a secondary transfer inner roller 45*a* and a secondary transfer outer roller 45*b*. By applying a secondary transfer bias having a positive polarity to the secondary transfer outer roller 45*b*, the full-color image formed on the intermediate transfer belt 44*b* is transferred onto the sheet S. The secondary transfer inner roller 45*a* is disposed in an inner space of the intermediate transfer belt 44*b* so as to stretch the intermediate transfer belt 44*b* from the inside, and the secondary transfer outer roller 45*b* is disposed in a position opposing the secondary transfer inner roller 45*a* across the intermediate transfer belt 44*b*.

The fixing unit 46 includes a fixing roller 46*a* and a pressurizing roller 46*b*. The sheet S is nipped and conveyed between the fixing roller 46*a* and the pressurizing roller 46*b*, and the toner image transferred onto the sheet S is heated, pressurized, and thereby fixed to the sheet S. The fixing unit 46 is configured as a unit and is attachable to and detachable from the apparatus body 10.

The sheet conveyance unit 50 includes a before-secondary-transfer conveyance path 51, a before-fixing conveyance path 52, a discharge path 53, and a re-conveyance path 54, and conveys the sheet S fed from the sheet feeding unit 30 from the image forming section 40 to the sheet discharge portion 60.

The sheet discharge portion 60 includes a discharge roller pair 61 and a discharge tray 62. The discharge roller pair 61 is disposed downstream of the discharge path 53, and the discharge tray 62 is disposed downstream of the discharge roller pair 61. The discharge roller pair 61 feeds from a nip portion the sheet S conveyed through the discharge path 53, and discharges the sheet S onto the discharge tray 62 through a discharge port 10*a* defined in the apparatus body 10. The discharge tray 62 is a face-down tray that supports the sheet S discharged in an arrow X direction through the discharge port 10*a*.

The control unit 70 is constituted by a computer, and includes, for example, a CPU 70*a*, a ROM 70*b*, a RAM 70*c*, and an input/output circuit 70*d* as illustrated in FIG. 3. The ROM 70*b* stores a program for controlling each element of the image forming apparatus 1, the RAM 70*c* stores data temporarily, and the input/output circuit 70*d* communicates signals with external elements. The control unit 70 is connected to the image reading unit 20, the sheet feeding unit 30, the image forming section 40, the sheet conveyance unit 50, the sheet discharge portion 60, and the display unit 11*a* via the input/output circuit 70*d*, and communicates signals with each component to control the operations thereof. In addition, the control unit 70 is connected to the remaining-toner amount detection sensor 73 and the temperature detection sensor 74, and is capable of obtaining information detected by the sensors 73 and 74. Further, the control unit 70 allows a user to instruct operations or configure settings by, for example, inputting instruction through a computer that is not illustrated and is connected to the apparatus body 10 or operating the operation panel 11.

The control unit 70 is capable of detecting whether or not the amount of toner in the toner hopper 41 reaches the first set amount on the basis of the results of detection by the remaining-toner amount detection sensor 73. The control unit 70 serves as a toner amount detection unit and is capable of detecting a value related to the amount of toner contained in the toner container 42. The control unit 70 drives the toner container driving unit 71 in a direction that causes the toner container 42 to rotate in the reverse rotation direction in the case where it has been detected that the amount of toner in the toner hopper 41 does not reach the first set amount and the amount of toner contained in the toner container 42 detected by the toner amount detection unit reaches a threshold value M, i.e., one example of a second set amount. In the present exemplary embodiment, the threshold value M corresponds to the amount of toner that allows the toner contained in the toner container 42 to reach an upper edge 42*d* of the discharge port 42*b* of the toner container 42 illustrated in FIGS. 4A and 4B, and is a value related to the accumulated number of rotation (rotations) of the toner container 42. That is, in the present exemplary embodiment, the control unit 70 calculates the amount of toner in the toner container 42 on the basis of the accumulated number of rotation of the toner container 42, and compares the calculated amount with the threshold value M. In the present exemplary embodiment, it is determined that the amount of toner contained in the toner container 42 reaches the threshold value M in the case where the accumulated number of rotation of the toner container 42 does not reach a predetermined accumulated number.

In addition, the control unit 70 sets a reverse rotation time on the basis of information obtained by the temperature detection sensor 74, and drives the toner container driving unit 71 in a direction that causes the toner container 42 to rotate in the reverse rotation direction. Here, the control unit 70 sets a first reverse rotation time as the reverse rotation time in the case where the temperature is a first temperature, and sets a second reverse rotation time longer than the first reverse rotation time as the reverse rotation time in the case where the temperature is a second temperature higher than the first temperature. In supplying the toner from the toner container 42 to the toner hopper 41, the control unit 70 drives the toner container driving unit 71 in the direction that causes the toner container 42 to rotate in the reverse rotation direction before driving the toner container driving unit 71 in the direction that causes the toner container 42 to rotate in the normal rotation direction.

Next, image formation operation by the image forming apparatus 1 having the configuration described above will be described.

First, as illustrated in FIG. 2, the photosensitive drum 81 is rotated and the surface thereof is electrified by the electrifying roller 82 after starting the image formation operation. Then, the laser scanner 43 irradiates the photosensitive drum 81 with laser light on the basis of image information, and an electrostatic latent image is thereby formed on the surface of the photosensitive drum 81. The electrostatic latent image is visualized by being developed with the toner attaching to the electrostatic latent image, and is then transferred to the intermediate transfer belt 44*b*.

Meanwhile, in parallel with this operation of forming a toner image, the feeding rollers 32*a* and 32*b* rotate to separate and feed an uppermost sheet S in the sheet cassettes 31*a* and 31*b*. Then, the sheet S is conveyed to the secondary transfer unit 45 through the before-secondary-transfer conveyance path 51 at a timing matching the timing of conveying the toner image on the intermediate transfer belt 44*b*. Further, the toner image is transferred from the intermediate transfer belt 44*b* onto the sheet S, and the sheet S is conveyed to the fixing unit 46. The unfixed toner image is fixed to the surface of the sheet S by being heated and pressurized at the fixing unit 46, and the sheet S is discharged through the discharge port 10*a* by the discharge roller pair 61 and is supported on the discharge tray 62.

Figure 5A:
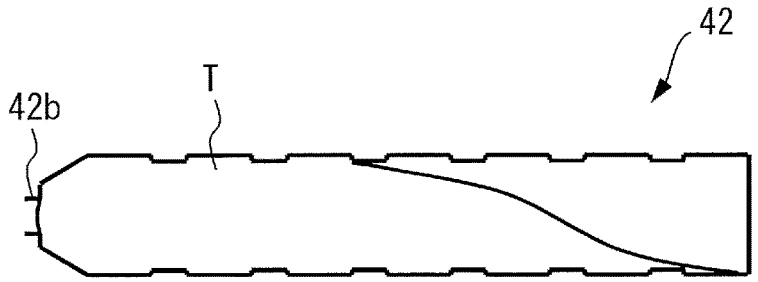
FIG. 5A is a side view of the toner container of the image forming apparatus according to the first exemplary embodiment and illustrates a state where a discharge port is clogged with toner due to a normal rotation.

The fluidity of the toner in the toner container 42 described above will be described herein with reference to FIGS. 5A to 6B. When toner T is in a high-temperature and high-humidity environment, the fluidity of the toner T decreases, and the toner container 42 becomes likely to be clogged with the toner T in the vicinity of the discharge port 42*b* as shown in FIG. 5A. Moreover, since the toner T is conveyed in the whole of the toner container 42 in the longitudinal direction due to the rotation of the toner container 42, the toner T in the vicinity of the discharge port 42*b* is packed by being compressed by the conveyed toner T. Therefore, the amount of toner that can be discharged further decreases.

Figure 5B:
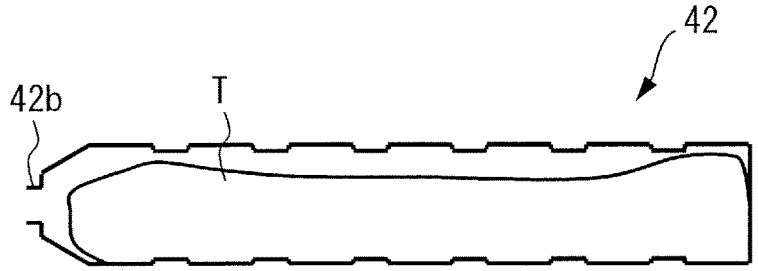
FIG. 5B illustrates a state where a reverse rotation is started after the state illustrated in FIG. 5A.
Figure 5C:
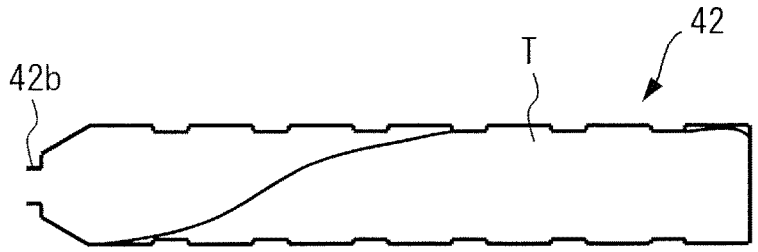
FIG. 5C illustrates the toner container in a state where the reverse rotation has been continued after the state illustrated in FIG. 5B.

On the contrary, as illustrated in FIG. 5B, the toner T in the toner container 42 is conveyed to the side opposite to the discharge port 42*b* by rotating the toner container 42 in the reverse rotation direction. This lowers the toner plane in the vicinity of the discharge port 42*b* and does not advance the packing of the toner T. Further, as illustrated in FIG. 5C, a space is generated in the vicinity of the discharge port 42*b*.

Figure 6A:
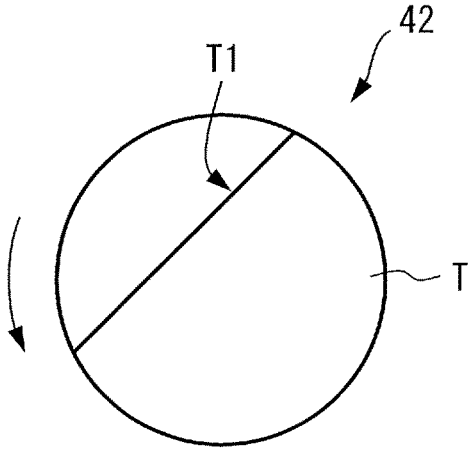
FIG. 6A is a section view of the toner container of the image forming apparatus according to the first exemplary embodiment and illustrates a case where a large space is present in the vicinity of the discharge port.
Figure 6B:
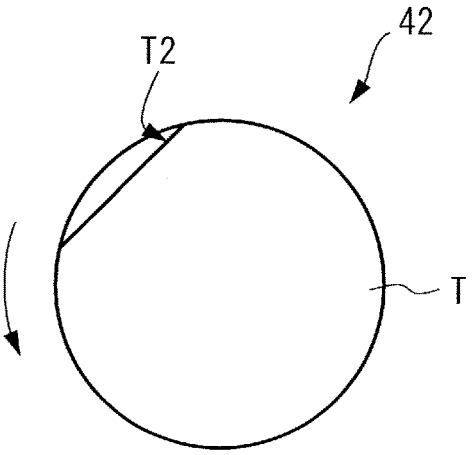
FIG. 6B is a section view of the toner container of the image forming apparatus according to the first exemplary embodiment and illustrates a case where a large space is not present in the vicinity of the discharge port.

As illustrated in FIG. 6A, the rotation of the toner container 42 also causes the toner T to move in the radial direction of the toner container 42. When there is a sufficient space between a toner plane T1 and the toner container 42, the toner T can move freely and thus can slide on the toner plane T1 efficiently. Once the toner T starts moving freely in this way, the toner T is mixed with air and exhibits a liquid-like behavior, resulting in a high fluidity. Meanwhile, when there is no sufficient space between a toner plane T2 and the toner container 42 as illustrated in FIG. 6B, the toner T does not move freely and thus cannot slide on the toner plane T2 efficiently. Therefore, the packing of the toner T is not cancelled and the toner T exhibits a solid-like behavior.

The basis of the effect of improving the fluidity by rotating the toner container 42 in the reverse rotation direction lies in the fact that lowering the toner plane T1 in the vicinity of the discharge port 42*b* secures a space for the toner T to move in and thus allows the toner T to be mixed with air in this way. Thus, in the case where the toner plane of the toner container 42 after an operation of replenishment has been completed is lower than the upper edge 42*d* of the discharge port 42*b*, the toner plane does not need to be lowered by rotating the toner container 42 in the reverse rotation direction. Based on this idea, the height of the upper edge 42*d* of the discharge port 42*b* is set as the threshold value M related to the amount of toner.

Figure 7:
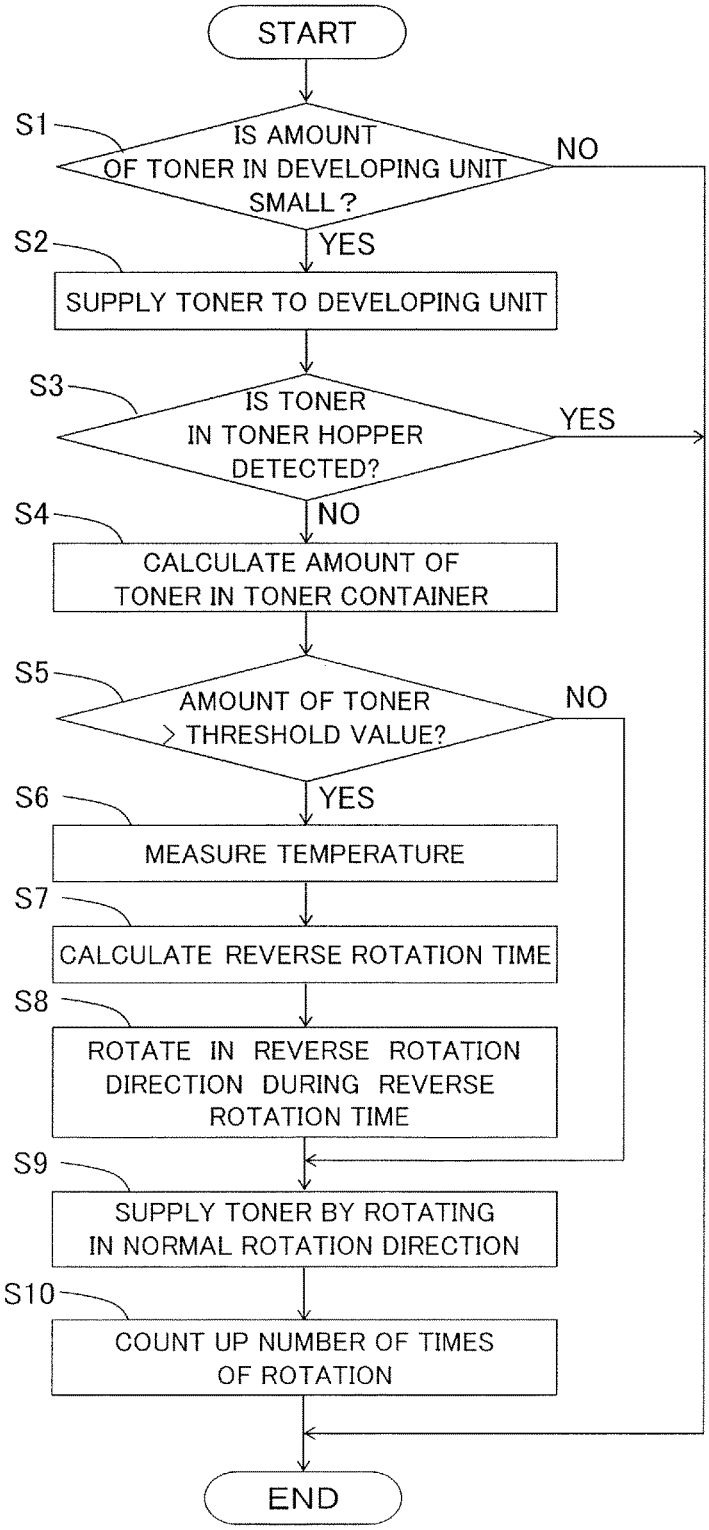
FIG. 7 is a flowchart illustrating a process flow in a case where the toner is supplied to a toner hopper from the toner container of the image forming apparatus according to the first exemplary embodiment.

Next, a process flow of supplying the toner from the toner container 42 to the toner hopper 41 in the image forming apparatus 1 described above will be described in detail with reference to the flowchart of FIG. 7 and the illustration of FIG. 5.

In step S1, while the power of the image forming apparatus 1 is on, the control unit 70 detects at an appropriate timing the amount of toner in the developer container 85 of the developing unit 83 with the toner density detection sensor 89, and determines whether or not the amount of toner in the developer container 85 of the developing unit 85 is less than the predetermined threshold value. In the case where the control unit 70 determines that the amount of toner in the developing unit 83 is less than the predetermined threshold value, the process ends in this step.

In the case where it has been determined that the amount of toner in the developing unit 83 is less than the predetermined threshold value, the control unit 70 drives the supplying screw driving unit 72 to rotate the supplying screw 48, and thereby supplies the toner from the toner hopper 41 to the developing unit 83 in step S2. If the toner is repetitively supplied to the developing unit 83 due to the drive of the supplying screw driving unit 72, the amount of toner accommodated in the toner hopper 41 will decrease.

In step S3, the control unit 70 determines whether or not the toner in the toner hopper 41 is detected by the remaining-toner amount detection sensor. In the case where the control unit 70 has determined that the toner in the toner hopper 41 is detected, the process ends in this step. In the case where it has been determined that the toner in the toner hopper 41 is not detected, the control unit 70 obtains the accumulated number of rotation of the toner container 42 on the basis of, for example, record data stored in a memory such as the RAM 70*c*, and calculates the amount of toner in the toner container 42 estimated from the accumulated number in step S4.

In steps S5, the control unit 70 determines whether or not the estimated amount of toner reaches the threshold value M, in other words, determines whether or not the accumulated number of rotation of the toner container 42 is less than a predetermined number of times of rotation. In the case where it has been determined that the estimated amount of toner reaches the threshold value M, in other words, that the accumulated number of rotation of the toner container 42 is less than the predetermined number of times of rotation, the control unit 70 measures the temperature inside the apparatus body 10 with the temperature detection sensor 74 in step S6. In step S7, the control unit 70 estimates the temperature inside the toner container 42 on the basis of the results of detection by the temperature detection sensor 74, and calculates the reverse rotation time from the estimated temperature. This calculation can be performed by, for example, referring to a table indicating a preset correlation between the temperature and the reverse rotation time. In step S8, the control unit 70 drives the toner container driving unit 71 during the set reverse rotation time to rotate the toner container 42 in the reverse rotation direction, and thereby agitates the toner to make the toner fluid. In this step, the state of the toner changes from the state illustrated in FIG. 5A to the state illustrated in FIG. 5C.

In the case where the reverse rotation time has elapsed or it has been determined that the estimated amount of toner does not reach the threshold value M in step S5, the control unit 70 drives the toner container driving unit 71 to rotate the toner container 42 in the normal rotation direction, and thereby supplies the toner from the toner container 42 to the toner hopper 41 in step S9. In this step, the state of the toner changes from the state illustrated in FIG. 5C to the state illustrated in FIG. 5A. Then, in step S10, the control unit 70 counts the number of rotation of the toner container 42 in the normal rotation direction and records the counted number on a memory such as the RAM 70*c*. To be noted, in the case where the toner container has been rotated in the reverse rotation direction, the toner will not be supplied to the toner hopper 41 immediately after the rotation in the reverse rotation direction even if the rotation is switched to the normal rotation direction. Thus, the control unit 70 may adjust the counted number of rotation in consideration of the number of rotation of the toner container 42 in the reverse rotation direction.

As described above, in the image forming apparatus 1 of the present exemplary embodiment, the control unit 70 drives the toner container driving unit 71 in the direction that causes the toner container 42 to rotate in the reverse rotation direction in the case where the value related to the amount of toner reaches the threshold value M. In a high-temperature and high-humidity environment, the fluidity of the toner may decrease, and, particularly in the case where the value related to the amount of toner reaches the threshold value M, the amount of toner in the toner container 42 is large and thus it may be difficult to discharge the toner through the discharge port 42*b*. However, the image forming apparatus 1 of the present exemplary embodiment agitates the toner in the toner container 42 by moving the toner to the side opposite to the discharge port 42*b* even in the case where the amount of toner in the toner container 42 is large or the image forming apparatus 1 is in a high-temperature or high-humidity environment in which the fluidity of the toner decreases. Thus, the decrease in the fluidity can be suppressed, and the clogging of the toner container 42 with the toner caused by the decrease in the fluidity of the toner can be thereby suppressed even in an environment that causes the fluidity of the toner to decrease, such as the high-temperature and high-humidity environment.

In addition, according to the image forming apparatus 1 of the present exemplary embodiment, the productivity of the image forming apparatus 1 does not decrease because the toner can be supplied without rotating the toner container 42 in the reverse rotation direction in the case where the value related to the amount of toner in the toner container 42 does not reach the threshold value M.

For the image forming apparatus 1 of the present exemplary embodiment described above, the case where the control unit 70 determines whether or not the estimated amount of toner reaches the threshold value M in step S5 has been described. However, the exemplary embodiment is not limited to this. For example, the control unit 70 may determine whether or not the accumulated number of rotation of the toner container 42 has reached a threshold value. In this case, the control unit 70 does not calculate the amount of toner itself. However, the control unit 70 can perform the same operation by using the accumulated number of rotation of the toner container 42 as the value related to the amount of toner and by regarding the accumulated number reaching the threshold value as corresponding to the amount of toner reaching the threshold value. In this case, the control can be simplified compared to the case where the amount of toner itself is calculated.

In addition, for the image forming apparatus 1 of the present exemplary embodiment, the case where the temperature detection sensor 74 serving as the temperature detection unit is also applied as the information obtaining unit has been described. However, the exemplary embodiment is not limited to this. For example, a single humidity detection sensor or the combination of the humidity sensor and the temperature detection sensor may be used as the information obtaining unit. Alternatively, for example, control of detecting turning on of the fixing unit 46 and estimating a rise in the temperature of the toner container 42 may be used as the information obtaining unit.

In addition, for the image forming apparatus 1 of the present exemplary embodiment, the case where the control unit 70 causes the toner container 42 to rotate in the reverse rotation direction for the reverse rotation time in the case where the amount of toner reaches the threshold value M and then the operation of replenishment is performed has been described. However, the exemplary embodiment is not limited to this. For example, in the case where the amount of toner reaches the threshold value M, the operation of replenishment may be performed after sufficiently agitating the toner by repetitively rotating the toner container 42 in the reverse rotation direction and the normal rotation direction. In this case, the rotation of the toner container 42 in the normal rotation direction does not necessarily cause the toner to be discharged.

In addition, for the image forming apparatus 1 of the present exemplary embodiment, the case where the image forming section 40 includes the toner hopper 41 and the remaining-toner amount detection sensor 73 has been described. However, the exemplary embodiment is not limited to this and the image forming section 40 does not need to include the toner hopper 41 and the remaining-toner amount detection sensor 73. In this case, the control unit 70 detects the decrease in toner density with the toner density detection sensor 89 that detects the toner density inside the developer container 85, and, in the case where the value related to the amount of toner reaches the threshold value M, drives the toner container driving unit 71 in the direction that causes the toner container 42 in the reverse rotation direction.

Second Exemplary Embodiment

Figure 8:
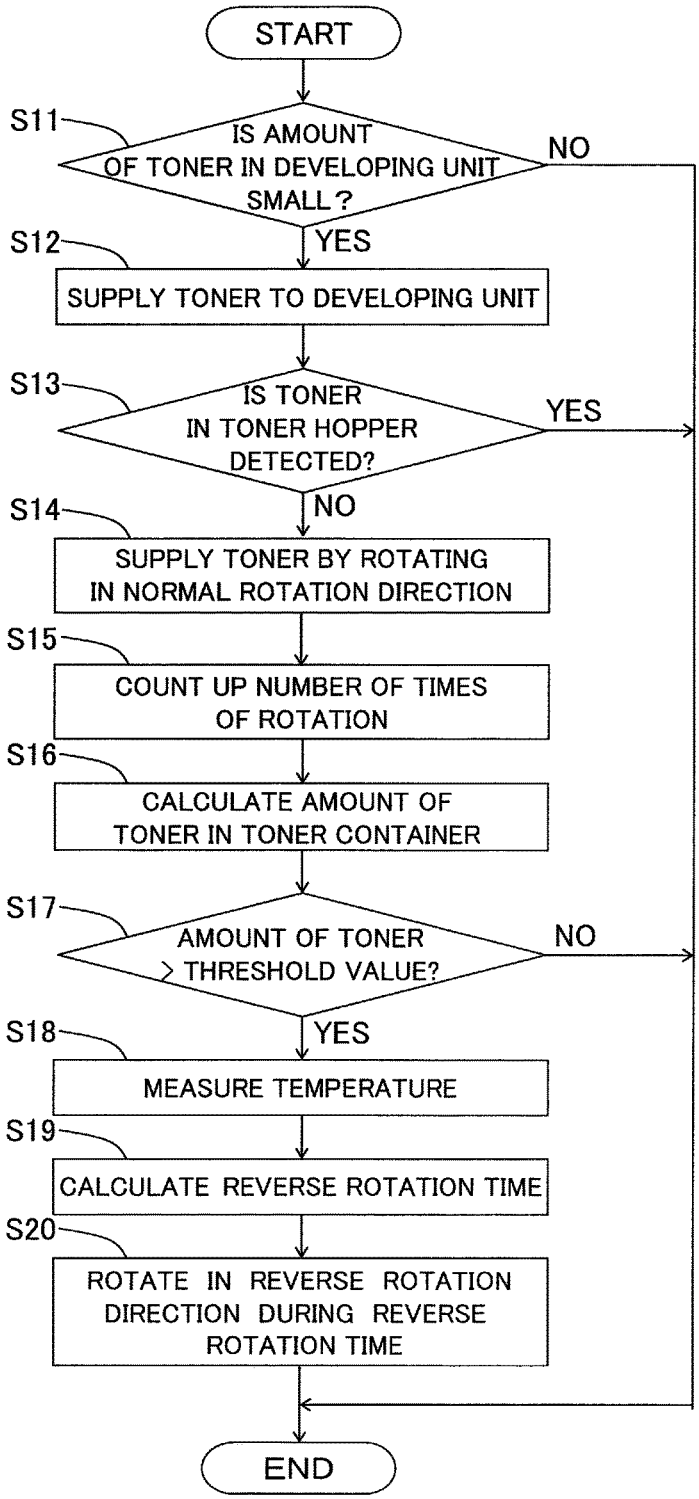
FIG. 8 is a flowchart illustrating a process flow in a case where toner is supplied to a toner hopper from a toner container of an image forming apparatus according to a second exemplary embodiment.

Next, a second exemplary embodiment of the present invention will be described in detail with reference to FIG. 8. The present exemplary embodiment is different from the first exemplary embodiment in that the toner container 42 is caused to rotate in the normal rotation direction after rotating in the reverse rotation direction in the process flow of the control unit 70; other elements are the same as the first exemplary embodiment. Therefore, the same reference numerals are given to the same elements and detailed descriptions of the same elements will be omitted herein. That is, in supplying the toner from the toner container 42 to the toner hopper 41, the control unit 70 of the present exemplary embodiment drives the toner container driving unit 71 in the direction that causes the toner container 42 to rotate in the reverse rotation direction after driving the toner container driving unit 71 in the direction that causes the toner container 42 to rotate in the normal rotation direction.

The process flow of supplying the toner from the toner container 42 to the toner hopper 41 according to the image forming apparatus 1 of the present exemplary embodiment will be described in detail with reference to the flowchart of FIG. 8.

In step S11, while the power of the image forming apparatus 1 is on, the control unit 70 detects at an appropriate timing the amount of toner in the developer container 85 of the developing unit 83 with the toner density detection sensor 89, and determines whether or not the amount of toner in the developer container 85 is less than the predetermined threshold value. In the case where the control unit 70 determines that the amount of toner in the developing unit 83 is less than the predetermined threshold value, the process ends in this step.

In the case where it has been determined that the amount of toner in the developing unit 83 is less than the predetermined threshold value, the control unit 70 drives the supplying screw driving unit 72 to rotate the supplying screw 48, and thereby supplies the toner from the toner hopper 41 to the developing unit 83 in step S12. If the toner is repetitively supplied to the developing unit 83 due to the drive of the supplying screw driving unit 72, the amount of toner accommodated in the toner hopper 41 will decrease.

In step S13, the control unit 70 determines whether or not the toner in the toner hopper 41 is detected by the remaining-toner amount detection sensor 73. In the case where the control unit 70 has determined that the toner in the toner hopper 41 is detected, the process ends in this step. In the case where it has been determined that the toner in the toner hopper 41 is not detected, the control unit 70 drives the toner container driving unit 71 to rotate the toner container 42 in the normal rotation direction and thereby supplies the toner from the toner container 42 to the toner hopper 41 in step S14. In this step, the state of the toner changes from the state illustrated in FIG. 5C to the state illustrated in FIG. 5A. Then, in step S15, the control unit 70 counts the number of rotation of the toner container 42 in the normal rotation direction and records the counted number on a memory such as the RAM 70*c*.

In step S16, the control unit 70 obtains the accumulated number of rotation of the toner container 42 on the basis of, for example, record data stored in a memory such as the RAM 70*c*, and calculates the amount of toner in the toner container 42 estimated from the accumulated number. In step S17, the control unit 70 determines whether or not the estimated amount of toner reaches the threshold value M. In the case where it has been determined that the estimated amount of toner reaches the threshold value M, the control unit 70 measures the temperature inside the apparatus body 10 with the temperature detection sensor 74 in step S18. In step S19, the control unit 70 estimates the temperature inside the toner container 42 on the basis of the results of detection by the temperature detection sensor 74, and calculates the reverse rotation time from the estimated temperature. This calculation can be performed by, for example, referring to a table indicating a preset correlation between the temperature and the reverse rotation time. In step S20, the control unit 70 drives the toner container driving unit 71 during the set reverse rotation time to rotate the toner container 42 in the reverse rotation direction, and thereby agitates the toner to make the toner fluid. In this step, the state of the toner changes from the state illustrated in FIG. 5A to the state illustrated in FIG. 5C. In the case where the reverse rotation time has elapsed or it has been determined that the estimated amount of toner does not reach the threshold value M in step S17, the process ends in this step.

As described above, the image forming apparatus 1 of the present exemplary embodiment also drives the toner container driving unit 71 in the direction that causes the toner container 42 in the reverse rotation direction in the case where the value related to the amount of toner reaches the threshold value M. This suppresses the clogging of the toner container 42 with the toner caused by the decrease in the fluidity of the toner even in an environment that causes the fluidity of the toner to decrease, such as the high-temperature and high-humidity environment.

EXAMPLE

Figure 9A:
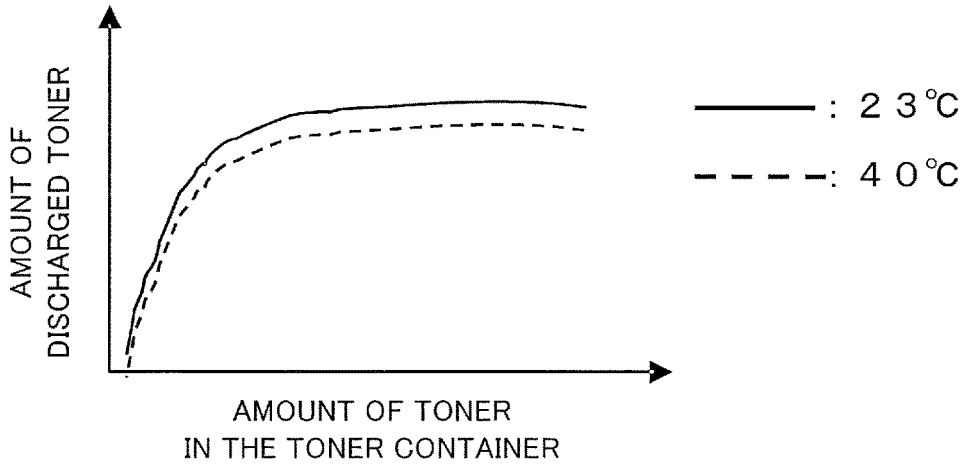
FIG. 9A is a graph illustrating a relationship between the amount of toner in the toner container and the amount of discharged toner at each temperature for an example.

The image forming apparatus 1 of the first exemplary embodiment described above was used and the relationship between the amount of toner in the toner container 42 and the amount of discharged toner was measured at a normal temperature of 23° C. and a high temperature of 40° C. The results are shown in FIG. 9A. In FIG. 9A, the horizontal axis corresponds to the amount of toner in the toner container 42, and the vertical axis corresponds to the amount of discharged toner for one rotation of the toner container 42. The discharge performance of the toner decreases gradually along with the decrease in the amount of the toner remaining in the toner container 42, and becomes particularly low when only a little amount of the toner remains in the toner container 42. This occurs because the toner plane becomes lower than the discharge port 42*b* as a result of the amount of toner becoming small, and the amount of toner that can pass through the discharge port 42*b* becomes small. If the toner container 42 is rotated in the normal rotation direction after the toner is sufficiently fluidized by rotating the toner container 42 in the reverse rotation direction, highly fluid toner present in the vicinity of the discharge port 42*b* will be discharged through the discharge port 42*b* by the baffles 49. As a result of this, as illustrated in FIG. 9A, no decrease in the amount of discharged toner was observed even at the high temperature.

Comparative Example

Figure 9B:
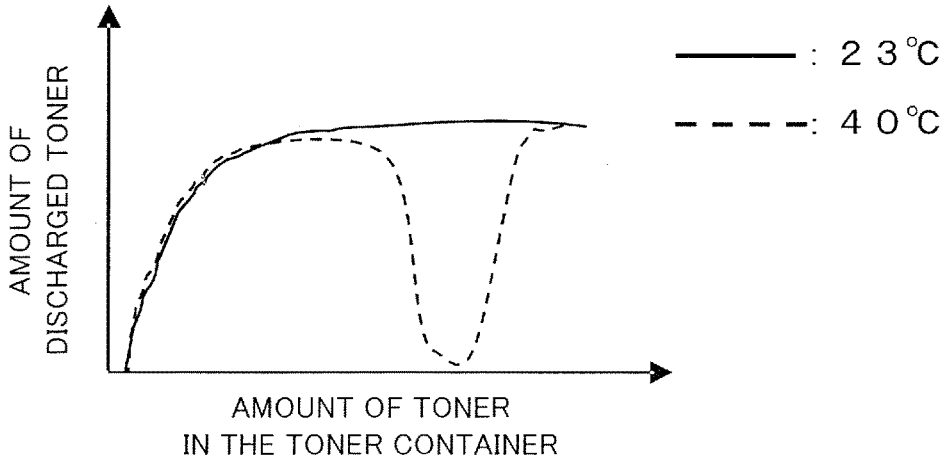
FIG. 9B is a graph illustrating a relationship between the amount of toner in the toner container and the amount of discharged toner at each temperature for a comparative example.

A conventional image forming apparatus 1 described above was used and the relationship between the amount of toner in a toner container and the amount of discharged toner was measured at the normal temperature of 23° C. and the high temperature of 40° C. without rotating the toner container in the reverse rotation direction. The results are shown in FIG. 9B. As illustrated in FIG. 9B, a discharge property changes at the high temperature due to a decrease in the fluidity of toner. As illustrated in FIG. 5A, the cause of the decrease in the amount of discharged toner occurring when the amount of toner in the toner container is large lies in the clogging with toner described above. Thus, it was revealed that, contrary to the conventional image forming apparatus, no decrease in the amount of discharged toner is observed at the high temperature with the image forming apparatus 1 of the first exemplary embodiment.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-223852, filed Nov. 16, 2015, which is hereby incorporated by reference herein in its entirety.

What is claimed is:

1. An image forming apparatus comprising:

a toner container having a cylindrical shape and configured to contain toner, the toner container comprising a discharge port through which the toner is discharged and a conveyance portion, the conveyance portion being configured to convey the toner toward the discharge port by rotation of the toner container in a first direction;

a toner amount detection unit configured to detect a value related to an amount of the toner contained in the toner container;

a driving unit configured to rotate the toner container in the first direction and in a second direction, the second direction being opposite to the first direction;

a toner accommodating unit configured to accommodate the toner discharged from the toner container;

a remaining-toner amount detection unit configured to detect whether an amount of the toner accommodated by the toner accommodating unit reaches a first set amount; and a control unit configured to control the driving unit such that the driving unit rotates the toner container in the second direction in a case where the remaining-toner amount detection unit has detected that the amount of the toner accommodated by the toner accommodating unit is smaller than the first set amount and the amount of the toner contained in the toner container detected by the toner amount detection unit reaches a second set amount.

2. The image forming apparatus according to claim 1, further comprising an information obtaining unit configured to obtain information related to an environment of the toner contained in the toner container, wherein the control unit sets a reverse rotation time based on the information obtained by the information obtaining unit and controls the driving unit such that the driving unit rotates the toner container in the second direction during the reverse rotation time.

3. The image forming apparatus according to claim 2, wherein the information obtaining unit is a temperature detection unit configured to detect a temperature inside an apparatus body which attachably and detachably houses the toner container, and wherein the control unit sets a first reverse rotation time as the reverse rotation time in a case where the temperature is a first temperature and sets a second reverse rotation time as the reverse rotation time in a case where the temperature is a second temperature, the second reverse rotation time being longer than the first reverse rotation time and the second temperature being higher than the first temperature.

4. The image forming apparatus according to claim 1, wherein the second set amount is an amount of the toner that allows the toner contained in the toner container to reach an upper edge of the discharge port of the toner container.

5. The image forming apparatus according to claim 1, wherein the toner contained in the toner container is calculated on the basis of a value related to an accumulated number of rotations of the toner container in the first direction.

6. The image forming apparatus according to claim 1, wherein the control unit controls the driving unit such that the driving unit rotates the toner container in the second direction before rotating the toner container in the first direction in a case where the toner is supplied from the toner container to the toner accommodating unit.

7. The image forming apparatus according to claim 1, wherein the control unit controls the driving unit such that the driving unit rotates the toner container in the second direction after rotating the toner container in the first direction in a case where the toner is supplied from the toner container to the toner accommodating unit.

* * * * *